US010123563B2

(12) United States Patent
Jackson et al.

(10) Patent No.: US 10,123,563 B2
(45) Date of Patent: Nov. 13, 2018

(54) PORTABLE HUMIDITY CONTROL DEVICE WITH A SEPARATE COMPARTMENT FOR HUMIDITY CONTROL MATERIALS

(71) Applicants: Marline Jackson, Atlanta, GA (US); JoeAnne Jackson, Atlanta, GA (US)

(72) Inventors: Marline Jackson, Atlanta, GA (US); JoeAnne Jackson, Atlanta, GA (US)

( * ) Notice: Subject to any disclaimer, the term of this patent is extended or adjusted under 35 U.S.C. 154(b) by 360 days.

(21) Appl. No.: 14/941,861

(22) Filed: Nov. 16, 2015

(65) Prior Publication Data

US 2017/0137201 A1 May 18, 2017

(51) Int. Cl.

| | |
|---|---|
| ***B65D 81/26*** | (2006.01) |
| ***A24F 23/00*** | (2006.01) |
| ***B65D 81/18*** | (2006.01) |
| ***B65D 25/04*** | (2006.01) |

(52) U.S. Cl.

CPC ..... *A24F 23/00* (2013.01); *B65D 25/04* (2013.01); *B65D 81/18* (2013.01); *B65D 81/266* (2013.01); *H05K 999/99* (2013.01)

(58) Field of Classification Search

CPC ..... B65D 81/18; B65D 25/04; B65D 43/02; B65D 81/24; B65D 81/22; B65D 81/268; B65D 81/266; A24F 23/00

USPC ..... 206/204, 242, 265, 276, 528, 538; 220/501, 524, 524.1, 524.7

See application file for complete search history.

(56) References Cited

U.S. PATENT DOCUMENTS

| | | | | | |
|---|---|---|---|---|---|
| 4,923,059 | A * | 5/1990 | Evers | B65D 85/1045 | 206/204 |
| 5,813,564 | A * | 9/1998 | Luo | B65D 81/268 | 206/204 |
| 7,892,327 | B2 * | 2/2011 | Neff | A24F 25/02 | 165/222 |
| 8,800,809 | B2 * | 8/2014 | Portier | F17C 11/00 | 206/204 |
| 2005/0173272 | A1 * | 8/2005 | Lemmons, IV | A24F 23/00 | 206/256 |
| 2010/0065077 | A1 * | 3/2010 | Lofgreen-Ohrn | A24F 23/00 | 131/329 |
| 2013/0098783 | A1 * | 4/2013 | Hernandez | F26B 9/003 | 206/204 |
| 2015/0101939 | A1 * | 4/2015 | Chang | H01L 23/02 | 206/204 |
| 2015/0291338 | A1 * | 10/2015 | Chen | B65D 81/268 | 206/204 |
| 2016/0031627 | A1 * | 2/2016 | Yeh | B65D 81/266 | 206/204 |

* cited by examiner

*Primary Examiner* — Luan K Bui
(74) *Attorney, Agent, or Firm* — John L. Sotomayor

(57) ABSTRACT

A humidity control device designed to fit inside a pocket, purse, or other small enclosure which contains a space to store materials in the humidity control device. The humidity control device is designed with a separate compartment within the space into which humidity control materials can be placed. The separate compartment within the humidity control device is designed with a lid which has an opening covered by a semi-permeable membrane which permits water vapor to travel from the separate compartment into the body of the humidity control device, thereby permitting materials which require some constant level of humidity to retain their ideal properties while being transported in the humidity control device.

18 Claims, 2 Drawing Sheets

200

300

500

PORTABLE HUMIDITY CONTROL DEVICE WITH A SEPARATE COMPARTMENT FOR HUMIDITY CONTROL MATERIALS

COPYRIGHT AND TRADEMARK NOTICE

A portion of the disclosure of this patent document contains material which is subject to copyright protection. The copyright owner has no objection to the facsimile reproduction of the patent document or the patent disclosure, as it appears in the Patent and Trademark Office patent file or records, but otherwise reserves all copyright rights whatsoever. Trademarks are the property of their respective owners.

BACKGROUND

Humidity, both on a large scale (such as weather in a particular location) and a small scale (such as the humidity inside of a house) strongly affects the health of humans and has equally profound effects on different types of fabrics, materials, and consumables. Humidity control is a fundamental requirement for storage of many different consumable products such as tobacco, *cannabis*, certain types of herbal medicine, and food. To provide optimal conditions for the use and life of a product, humidity control devices are used to monitor and control conditions in a storage humidity control. Different types of consumable products require different levels of humidity to have the maximum effect and to stay fresh. In some cases, excess humidity in a storage container damages the particular product or component; in other cases, a lack of humidity will dry out the product or component and render it useless, oftentimes at great expense.

Medicines are sold to consumers in airtight containers and consumers are urged to store medicines in a dry and cool environment. Certain medications and health supplements contain packets of silica to absorb any moisture that may be introduced into the container. Tobacco products, particularly cigars, are often stored in a device called a humidor that keeps humidity at the optimal level for long-term storage and quality. Humidors and other containers for storing tobacco, *cannabis*, certain herbal medicines, and food are equipped with humidity control devices.

BRIEF DESCRIPTION OF THE DRAWINGS

Certain illustrative embodiments illustrating organization and method of operation, together with objects and advantages may be best understood by reference detailed description that follows taken in conjunction with the accompanying drawings in which.

DETAILED DESCRIPTION

Figure 1:
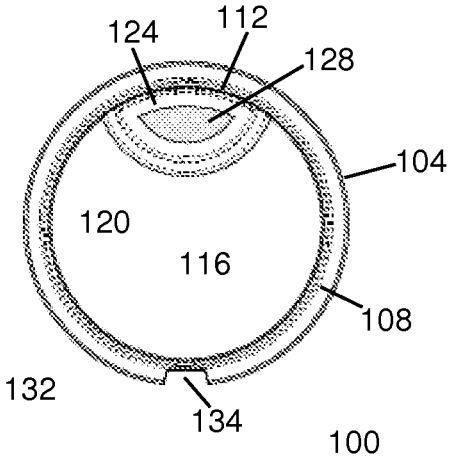
FIG. 1 is a top view of an open humidity control device with separate compartment having hidden lines consistent with certain embodiments of the present invention.

While this invention is susceptible of embodiment in many different forms, there is shown in the drawings and will herein be described in detail, specific embodiments, with the understanding that the present disclosure of such embodiments is to be considered as an example of the principles and not intended to limit the invention to the specific embodiments shown and described. In the description below, like reference numerals are used to describe the same, similar, or corresponding parts in the several views of the drawings.

The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically.

Reference throughout this document to "one embodiment," "certain embodiments," "an exemplary embodiment," or similar terms means that a particular feature, structure, or characteristic described in connection with the embodiment is included in at least one embodiment of the present invention. Thus, the appearances of such phrases or in various places throughout this specification are not necessarily all referring to the same embodiment. Furthermore, the particular features, structures, or characteristics may be combined in any suitable manner in one or more embodiments without limitation.

The term "humidity" refers to the amount of water vapor present in the air of a particular defined environment. The term "hygrometer" refers to a device which measures the relative humidity of a particular defined environment.

The term "humidity control device" refers to an enclosed container specifically designed for the purpose of storing materials with a lid that can be removed or tightened as desired and having a compartment for the insertion of humidity control materials.

The term "semi-permeable membrane" refers to a type of material which allows water vapor molecules to pass through the material but does not allow other types of molecules to pass through the material.

Humidity control is an important part of keeping certain consumables, such as tobacco or *cannabis*, in top condition as well as achieving maximum life expectancy for the consumable. Because of the different variables involved in preserving freshness or quality in consumables, many types of storage containers exist with some type of hygrometer or humidity control device (or both) built into the container. There are also hygrometers and humidity control devices that are standalone devices and can be placed into a storage container as needed. However, these standalone devices are designed to work in a fixed location and are not designed to make the storage container portable.

In the case of a storage container with either a standalone or incorporated humidity control device that is portable, the storage container and the humidity control device are not of a size and dimension that allows for convenience and easy storage in a pocket, purse, or other type of accessory used to carry personal belongings. If a consumer wishes to transfer the consumable to a storage container that is convenient and easy to store in a pocket or a purse, he or she must find a container that will allow for storage of the consumable as well as one that will allow a separate humidity control device to be added.

At present, transporting a small amount of a consumable is challenging because of the obstacles to maintaining proper humidity control in convenient portable storage containers. The only options available for humidity control devices that can be added to storage containers that are convenient and easy to carry in a pocket or purse are those that are not reusable, which may not appeal to consumers who are environmentally conscious and wish to limit waste. Additionally, because the humidity control devices are disposable, the consumer must continually purchase more of the humidity control devices, creating an ongoing expense for the consumer.

For these reasons, and more not enumerated in this document, it would be advantageous to have a portable humidity control device that is convenient and easy to carry in a pocket or purse, which has a separate compartment away from the main body of the container for humidity control. This separate compartment would store humidity control materials and would also have a removable compartment lid, covered by a semi-permeable membrane, into which humidity control materials may be placed. The portable humidity control device may have a cover that encloses the entire interior of the portable humidity control device, including the separate compartment within the portable humidity control device. The insertion of humidity control materials may be active to provide humidity to the main body of the portable humidity control device when the separate compartment lid is in place and the portable humidity control device cover is closed.

The instant disclosure recites a humidity control device which is portable as well as convenient and easy to store in a small area or carry within an accessory, such as a pocket or a purse. The humidity control device has a separate compartment, away from the main body of the container, onto which a removable lid may be placed. Humidity control materials are then installed within the separate compartment and covered with the lid of the separate compartment. The lid of the separate compartment has a semi-permeable membrane which allows the humidity control materials to diffuse water vapor throughout the humidity control device when the cover of the portable humidity control device is closed. Humidity control materials which compose the humidity control mechanism installed within the separate compartment may be replaced and/or reused as necessary to continue to diffuse humidity into the main body of the portable humidity control device.

The instant disclosure provides the consumer with a convenient and portable humidity control device for small amounts of consumables while also providing a separate compartment in which to carry humidity control materials. This separate compartment within humidity control materials inserted keeps the desired consumable carried within the main body of the portable humidity control device fresh and in optimal condition while also allowing the consumer to be more environmentally friendly.

In a non-limiting example, the humidity control device may be manufactured from plastic, ceramic, metal, or other sturdy, durable material and may have a coating on the surfaces of the humidity control device to provide protection against the elements as well as provide protection for the consumable stored in the container device from any potential interactions with the material of which the humidity control is constructed. In a non-limiting embodiment, the humidity control device may be configured in a cylindrical shape. However, the humidity control device may also be manufactured in other shapes, such as oval, square, rectangular, or any other shape as preferred by the user. The humidity control has a portion of the main body of the container device as a separate compartment completely and permanently sectioned off from the main interior space so that no material can pass through the wall of the separate compartment in either direction. The separate compartment of the humidity control device thus provides the consumer with the benefit of being able to store the desired contents in the main interior space of the humidity control device without fear of the contents placed in the main interior space of the humidity control device making direct contact with humidity control materials.

In an exemplary embodiment, the humidity control device may contain a separate compartment with a removable lid which fits on the separate portion of the container device, and in a non-limiting example, is made of the same material as the humidity control device. In this exemplary embodiment, the removable lid of the separate compartment would be composed of the same material as the walls of the separate compartment and the humidity control device. The separate compartment lid would have an opening taking up as large a portion of the lid as is feasible while still allowing the lid to securely fit over the separate compartment. In a non-limiting example, this opening would be covered with a semi-permeable membrane such as a wire screen, fabric, or other material which allows water vapor molecules to pass through the material, but prevent larger size objects from moving between the separate compartment and the main body of the humidity control device. This exemplary configuration permits the diffusion of water vapor from the humidity control materials contained within the separate compartment into the main space of the humidity control device while the cover of the humidity control device is closed, while restricting the humidity control materials to the separate compartment.

In an exemplary embodiment, the cover of the humidity control device itself may be comprised of a see-through material which allows the user to view the contents of the container without removing the lid. In an alternative non-limiting embodiment, the cover of the humidity control device may be translucent or opaque as the user may prefer.

In a non-limiting example, the user desires to carry his or her medical or food products while outside of his or her living space. The user may place a desired amount of medical or food products into the main body of the humidity control device. The user may then remove the lid from the separate compartment within the humidity control device. In a non-limiting example, the user may place a humidity control material such as water beads, a water-absorbing polymer which releases its water content to its surroundings and which can be rehydrated once dehydrated, into the separate compartment and places the lid, which contains a semi-permeable membrane over an open area, securely on top of the separate compartment.

In an alternative non-limiting example, the user may use cotton pieces soaked in water, pieces of fabric soaked in water, or any other material that can diffuse water vapor into the air surrounding the material. The user may place the lid securely back onto the separate compartment of the storage device and securely place the cover onto the humidity control device. The user may now place the humidity control device into a purse, pocket, or other accessory used to carry personal belongings and transport it where desired, while the inserted humidity control materials release water vapor into the air of the storage space of the humidity control device through the semi-permeable membrane material of the separate compartment lid. Once the humidity control device has been used for its instant purpose, or once the water beads or other humidity control materials have dehydrated, the user may remove the cover from the humidity control device, remove any remaining materials stored in the main body of the humidity control device, remove the lid to the separate compartment, remove the dehydrated water beads, and then is able to clean the humidity control device, the separate compartment, the lid to the separate compartment, and the cover of the humidity control device with cleaning products. The user may then use the humidity control device again for the same or another purpose.

Thus, in an embodiment, the system and device for providing humidity control comprises a container device of sufficient dimension to be held within a user's hand, such that the user may place the container device in a pocket, pocket book, backpack, or any way in which the user may wish to transport the device such that it is available for use when desired. The humidity control device having a separate compartment within the interior of the body of the humidity control device within which a user may insert humidity control materials, and a first removable lid for the separate compartment which has an opening covered by a semi-permeable membrane permitting water vapor to flow from the separate compartment into the body of the container device. The container device may have a lip extending at approximately about a 90 degree angle from the exterior edge of the walls of the container device and a removable cover for the humidity control device permitting the retention of materials placed within the humidity control device.

In an embodiment, the separate compartment within the humidity control device may be a humidity control compartment having attachment with the interior surface of the humidity control device sufficient to retain any humidity control materials in isolation from the remaining area of the interior of the humidity control device. The humidity control may have a second removable cover for the humidity control device that retains the first removable lid in a given position in the humidity control device when the first removable lid is positioned within the separate compartment. As required, the semi-permeable membrane may be a filter, mesh, fabric, or any other material permitting the diffusion of water vapor to the body of the humidity control device while restraining humidity control materials from moving into the body of the humidity control device. Additionally, the semi-permeable membrane material on the first removable lid can be removed and replaced with a semi-permeable membrane comprising a material different from the material removed. The humidity control separate compartment is wholly contained within the humidity control device, and the humidity control separate compartment comprises no more than about 25% of the interior area of the body of the humidity.

In an additional embodiment, the removable cover for the humidity control device is of a sufficient diameter to cover the entire exterior of the lip of the humidity control device, with the lip extending around the exterior of the humidity control device having a notch of sufficient dimension to permit a latching member associated with the removable cover of the container device to be inserted within said notch when the removable cover is placed into contact with the humidity control device.

To the accomplishment of the foregoing and related ends, the following description and annexed drawings set forth certain illustrative aspects and implementations. Other aspects, advantages, and novel features of the disclosure will become apparent from the following detailed description when considered in conjunction with the associated drawings.

Turning now to FIG. 1, this diagram presents a top view of an open humidity control device with hidden lines consistent with certain embodiments of the present invention. In an exemplary embodiment, a humidity control device is seen at 100. The device may be round, square, or any other shape that allows for a separate compartment with a removable lid as well as a space for storing materials. The top of the exterior wall of the humidity control device, with a lip that extends out from the walls themselves, is seen at 104. The profile of the exterior wall of the humidity control, represented by hidden lines, is seen at 108. In an exemplary embodiment, the humidity control device may be made from plastic, metal, acrylic, or any other material which provides a waterproof surface in which other items can be placed upon without damage. In a non-limiting example, the lip extending out from the top of the wall and the wall itself may be made from the same material as the humidity control device and may be covered in a protective coating so as to avoid contamination of the materials placed inside the humidity control device. The separate compartment inside the humidity control device is seen at 112. The fixed wall of the separate compartment, represented by hidden lines, is seen at 116. The wall of the separate compartment cover, represented by hidden lines, are seen at 120. In a non-limiting embodiment, the wall of the separate compartment cover is made from the same materials suggested above for the humidity control device itself. The lid of the separate compartment cover, with a lip that extends out from the top portion of the separate compartment cover, is seen at 124. The lip at 124 serves to provide a firm surface for the lid of the separate compartment to rest upon, preventing the compartment cover from falling to the bottom of the separate compartment, and preventing any damage to the materials within the separate compartment. The opening of the lid of the separate compartment cover, partially covered by a semi-permeable membrane, is seen at 128. The remainder of the humidity control device, the interior space where the user will place materials that he or she desires to transport and that need humidity control, is seen at 132. A cutout portion of the lip of the humidity control device of sufficient size to permit the insertion of a latch when a lid is place in contact with the lip of the humidity control device is seen at 134. In an alternative embodiment, the separate compartment cover may be the top portion of a removable insert that may be installed within the separate compartment, forming a cartridge-like interchangeable element that may be inserted and removed from the separate compartment.

Figure 2:
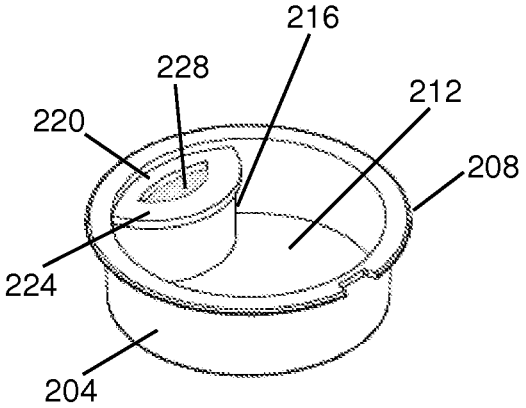
FIG. 2 is a front right isometric view of the interior of a humidity control device with separate compartment consistent with certain embodiments of the present invention.

Turning now to FIG. 2, this diagram presents a front right isometric view of the interior of a humidity control device consistent with certain embodiments of the present invention. The humidity control device itself, presented in a front right isometric view, is seen at 200. The wall of the humidity control device, viewed from the exterior, is seen at 204. The lip that extends outward from the top of the wall of the humidity control device is seen at 208. The interior space of the humidity control, where the user will store desired materials needing humidity control, is seen at 212. The fixed wall of the separate compartment within the humidity control device, viewed from the exterior of the separate compartment, is seen at 216. The separate compartment cover is seen generally at 220. The lid to the separate compartment, with its lip that extends outward from the top of the separate compartment cover, which is placed in contact with the separate compartment of the humidity control device, is seen at 224, and the screen which covers the opening in the separate compartment lid and which permits the transmission of water vapor from the separate compartment into the remainder of the humidity control device is seen at 228.

Figure 3:
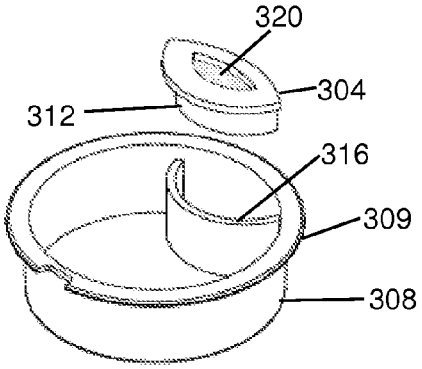
FIG. 3 is an exploded view of the interior of a humidity control device with separate compartment along with its separate components consistent with certain embodiments of the present invention.

Turning now to FIG. 3, this diagram presents an exploded view of the interior of a humidity control device along with its separate components consistent with certain embodiments of the present invention. In this exploded view diagram, the humidity control device is seen at 300. The wall of the separate compartment, onto which the separate compartment lid will be placed, is seen at 304. The wall of the humidity control device itself 308, along with the associated lip extending out from the top of the wall 309, are seen from both the inside of the separate compartment and from the inside of the storage space of the humidity control device. The body of the separate compartment cover, extending vertically at 90 degrees from the bottom surface of the separate compartment cover, is seen generally at 312. In an exemplary embodiment, the separate compartment cover and the walls of the separate compartment can be formed in a square, triangle, or any other shape or manner which allows for a separate compartment that may be used to emplace humidity control materials. The wall of the separate compartment is seen at 316. The opening in the lid of the separate compartment cover that is covered by a semi-permeable membrane is seen at 320. In a preferred embodiment, this opening covered by the semi-permeable membrane is as large as feasible while still maintaining engineering standards and material integrity.

Figure 4:
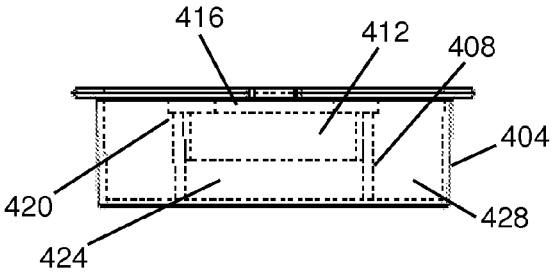
FIG. 4 is a frontal view of a humidity control device with separate compartment having hidden lines consistent with certain embodiments of the present invention.

Turning now to FIG. 4, this diagram presents a frontal view of a humidity control device with hidden lines consistent with certain embodiments of the present invention. The humidity control device, shown here from a frontal view and with visible hidden lines, is seen at 400. The wall of the humidity control device itself, along with a hidden line representing its thickness, is seen at 404. The wall of the separate compartment, along with a hidden line representing its thickness, is seen at 408. The separate compartment cover, represented by hidden lines, is seen in contact with the separate compartment at 412.

In an exemplary embodiment, the cover of the separate compartment is viewed while it is secured to the separate compartment at 416. In a preferred embodiment, the separate compartment lid is aligned no higher than the lower edge of the lip extending outward from the wall of the humidity control device seen at 420. The separate compartment is seen at 424, and the space inside the humidity control device itself, where the user will store desired materials, is seen at 428.

Figure 5:
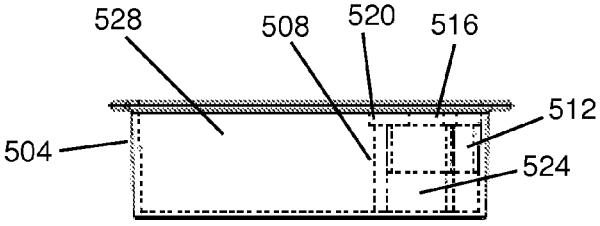
FIG. 5 is a side view of a humidity control device with separate compartment having hidden lines consistent with certain embodiments of the present invention.

Turning now to FIG. 5, this diagram presents a side view of a humidity control device with hidden lines consistent with certain embodiments of the present invention. The humidity control device, shown here from a side view and with visible hidden lines, is seen at 500. The wall of the humidity control device itself, along with a hidden line representing its thickness, is seen at 504. The wall of the separate compartment, along with a hidden line representing its thickness, is seen at 508. The separate compartment cover, represented by hidden lines, is seen in contact with the upper surface of the walls of the separate compartment at 512. The lid of the separate compartment is viewed at 516. The lip extending outward from the wall of the humidity control device is seen at 520. The remaining space inside the separate compartment is seen at 524. Finally, the space inside the humidity control device itself, where the user will store desired materials, is seen at 528.

While certain illustrative embodiments have been described, it is evident that many alternatives, modifications, permutations, and variations will become apparent to those skilled in the art in light of the foregoing description.

What is claimed is:

1. A humidity control device for providing humidity control, comprising:

a humidity control device of sufficient dimension to be held within a user's hand;

a separate compartment within an interior of a body of the humidity control device;

a removable lid covering the separate compartment which has an opening covered by a semi-permeable membrane permitting water vapor to flow from the separate compartment into the body of the humidity control device;

a lip extending at approximately about a 90-degree angle from an exterior edge of walls of the humidity control device; and a removable cover for the humidity control device permitting the retention of materials placed within the humidity control device;

where the separate compartment is accessible by removing said removable lid for the separate compartment without disturbing content placed in the interior of the body of the humidity control device.

2. The device in claim 1, where said separate compartment is a humidity control compartment for the insertion and retention of humidity control materials.

3. The device in claim 1, where said removable cover for the humidity control device retains the removable lid of the separate compartment in a given position in the humidity control device when the removable lid is positioned over the separate compartment.

4. The device in claim 1, where the semi-permeable membrane comprises a filter, mesh, fabric, or any other material permitting the diffusion of water vapor to the body of the humidity control device while restraining humidity control materials from moving into the body of the humidity control device.

5. The device in claim 1, where semi-permeable membrane material on the removable lid can be removed and replaced with a semi-permeable membrane comprising a material different from the material removed.

6. The device in claim 2, where said separate compartment is wholly contained within the humidity control device.

7. The device in claim 1, where said removable cover for the humidity control device is of a sufficient diameter to cover the entire exterior of the lip of the humidity control device.

8. The device in claim 7, where the lip extending around the exterior of the humidity control device has a notch of sufficient dimension to permit a latching member associated with the removable cover of the humidity control device to be inserted within said notch when the removable cover is placed into contact with the humidity control device, said notch comprising an indentation of the outer circumference of the lip which is apparent as a gap when the lip is viewed from above.

9. The device in claim 2, where the separate compartment comprises no more than about 25% of the interior area of the body of the humidity control device when viewed from directly above the humidity control device.

10. A system for providing humidity control, comprising:

a humidity control device of sufficient dimension to be held within a user's hand;

a separate compartment within an interior of a body of the humidity control device within which a user may insert humidity control materials;

a removable lid covering the separate compartment which has an opening covered by a semi-permeable membrane permitting water vapor to flow from the separate compartment into the body of the humidity control device;

a lip extending at approximately about a 90-degree angle from the exterior edge of walls of the humidity control device; and a removable cover for the humidity control device permitting the retention of materials placed within the humidity control device;

where the separate compartment is accessible by removing the removable lid for the separate compartment without disturbing content placed in the interior of the body of the humidity control device.

11. The system of claim 10, where said separate compartment is a humidity control compartment having attachment with the interior surface of the humidity control device sufficient to retain any humidity control materials in isolation from the remaining area of the interior of the humidity control device.

12. The system of claim 10, where said removable cover for the humidity control device retains the removable lid of the separate compartment in a given position in the humidity control device when the removable lid is positioned within the separate compartment.

13. The system of claim 10, where the semi-permeable membrane comprises a filter, mesh, fabric, or any other material permitting the diffusion of water vapor to the body of the humidity control device while restraining humidity control materials from moving into the body of the humidity control device.

14. The system of claim 10, where a semi-permeable membrane material in a removable lid can be removed and replaced with a semi-permeable membrane comprising a material different from the material removed.

15. The system of claim 11, where said separate compartment is wholly contained within the humidity control device.

16. The system of claim 10, where said removable cover for the humidity control device is of a sufficient diameter to cover the entire exterior of the lip of the humidity control device.

17. The system of claim 16, where the lip extending around the exterior of the humidity control device has a notch of sufficient dimension to permit a latching member associated with the removable cover of the humidity control device to be inserted within said notch when the removable cover is placed into contact with the humidity control device, said notch comprising an indentation of the outer circumference of the lip which is apparent as a gap when the lip is viewed from above.

18. The system of claim 11, where the separate compartment comprises no more than about 25% of the interior area of the body of the humidity control device when viewed from directly above the humidity control device.

* * * * *